US007553192B2

(12) United States Patent
Kuo et al.

(10) Patent No.: US 7,553,192 B2
(45) Date of Patent: Jun. 30, 2009

(54) ELECTRICAL CONNECTOR

(75) Inventors: Peter Kuo, Tu-Cheng (TW); Bing Du, Kunshan (CH)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/149,000

(22) Filed: Apr. 24, 2008

(65) Prior Publication Data

US 2008/0268689 A1 Oct. 30, 2008

(30) Foreign Application Priority Data

Apr. 24, 2007 (CN) ..... 2007 1 0022022

(51) Int. Cl.
*H01R 25/00* (2006.01)

(52) U.S. Cl. ..... 439/638; 361/735

(58) Field of Classification Search ..... 439/638, 439/76.1, 655, 928; 361/735, 736
See application file for complete search history.

(56) References Cited

U.S. PATENT DOCUMENTS 2,960,605 A * 11/1960 Montz ..... 338/67
6,533,610 B1 * 3/2003 Dai et al. ..... 439/581
7,467,961 B2 * 12/2008 Kuo ..... 439/248
2008/0057764 A1 3/2008 Kuo
2008/0188118 A1 * 8/2008 Kuo et al. ..... 439/367

* cited by examiner

*Primary Examiner*—Phuong K Dinh
(74) *Attorney, Agent, or Firm*—Wei Te Chung

(57) ABSTRACT

An electrical connector (100) includes a base (3), which is shaped in a basin and comprises at least one elastic assembly (35). A first connector module (5) and a second connector module (6) are both assembled on the base and they are electrically connected to each other. Each connector module communicates with an outside complementary connector. The electrical connector comprises an inner cover (2) which is attached to the base and the inner cover defines a plurality of fixing slots (21). The electrical connector further comprises a top cover (1) which forms a plurality of fixing members (17, 17') thereof and the fixing members correspond to the fixing slots of the inner cover. The fixing members are engaged with or separated from the fixing slots by a rotation of the inner cover along a clockwise or counterclockwise direction by virtue of the elastic assembly.

19 Claims, 10 Drawing Sheets

ELECTRICAL CONNECTOR

BACKGROUND OF THE INVENTION

1. Field of the Invention

The present invention relates generally to electrical connectors, and more particularly to an electrical connector having an advanced locking means.

2. Description of Related Arts

An electrical connector having a top shield and a bottom shield, which two associate with each other to define a receiving room, is known in appliance. Circuit trails and at least two connector modules jointed together by the circuit trails are all received in the receiving room. Each connector module contacts with a complementary connector for transferring information therebetween.

Two traditional methods are used in daily products of such kind for combining the top shield and the bottom shield together, one of which is a screwing method, however, users need a screwdriver or a similar tool to fix the screws into fixing holes defined both on the top shield and the bottom shield, which makes the assembling process rather troublesome and time-consuming and so does the screwing out process. Furthermore, screws are exposed outside of the electrical connector, which destroys an aesthetic impression of the product. A second traditional method is an engagement means, such as a protrusion formed on the top shield mating with an opening defined on the bottom shield. During the assembling process, users only need to press the top shield and then, make the protrusion protrude into the opening or the like. An advantage of the pressing against method is that it makes the assembling process simple, meanwhile, a disadvantage thereof is existed that users have difficulty in disengaging the top shield away from the bottom shield during the disassembling process. After plurality times of breaking the top shield away from the bottom shield, the locking means may be destroyed, which causes the product not to be usable in the end.

Hence, an improved electrical connector having an advanced locking means is desired.

SUMMARY OF THE INVENTION

Accordingly, an object of the present invention is to provide an electrical connector having an advanced locking means.

To achieve the above object, an electrical connector includes a base, which is shaped in a basin and comprises at least one elastic assembly. A first connector module and a second connector module are both assembled on the base and they are electrically connected to each other. Each connector module communicates with an outside complementary connector. The electrical connector comprises an inner cover which is attached to the base and the inner cover defines a plurality of fixing slots. The electrical connector further comprises a top cover which forms a plurality of fixing members thereof and the fixing members correspond to the fixing slots of the inner cover. The fixing members are engaged with or separated from the fixing slots by a rotation of the inner cover along a clockwise or counterclockwise direction by virtue of the elastic assembly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
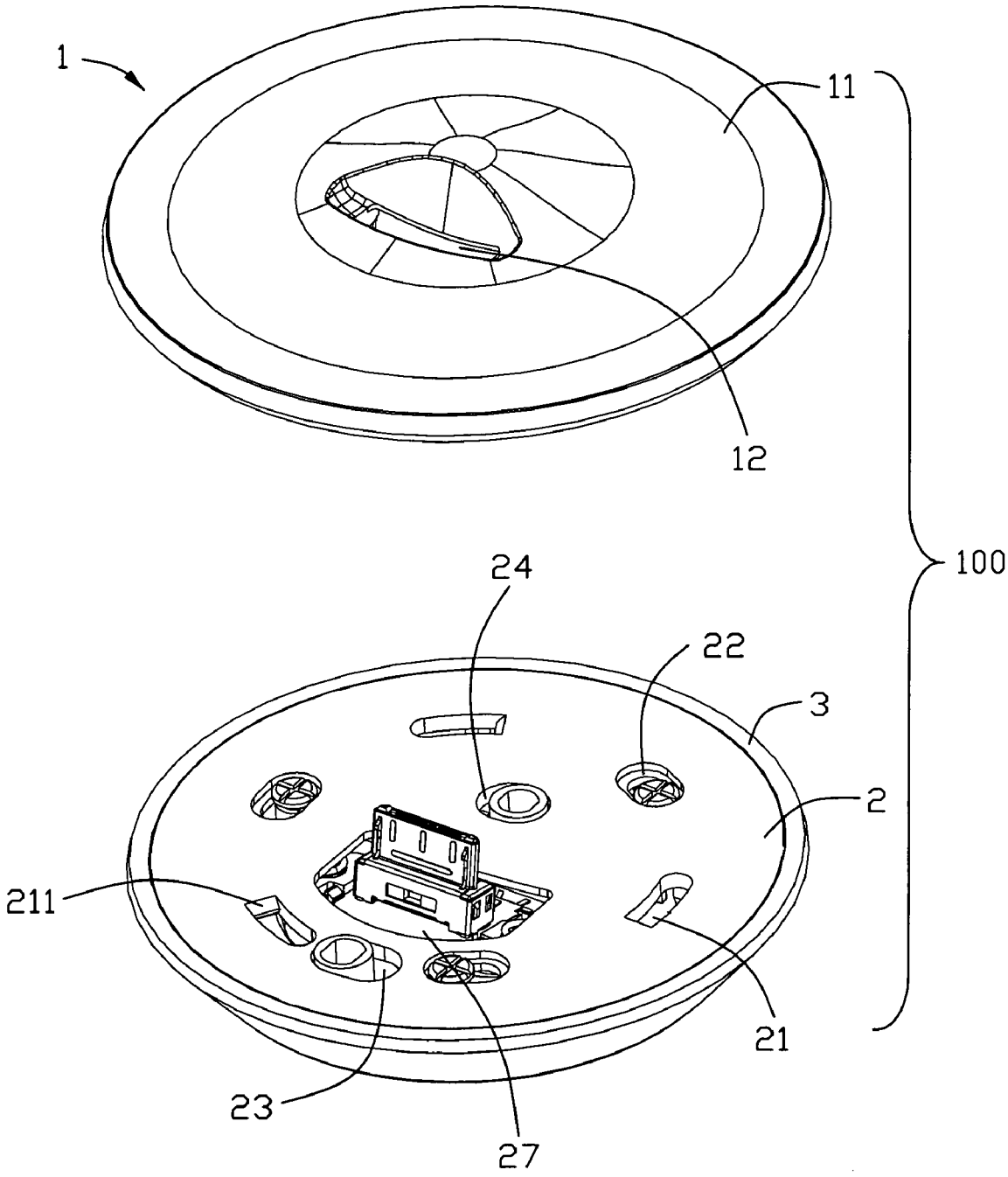
FIG. 1 is a perspective, partly exploded view of an electrical connector according to this invention.
Figure 2:
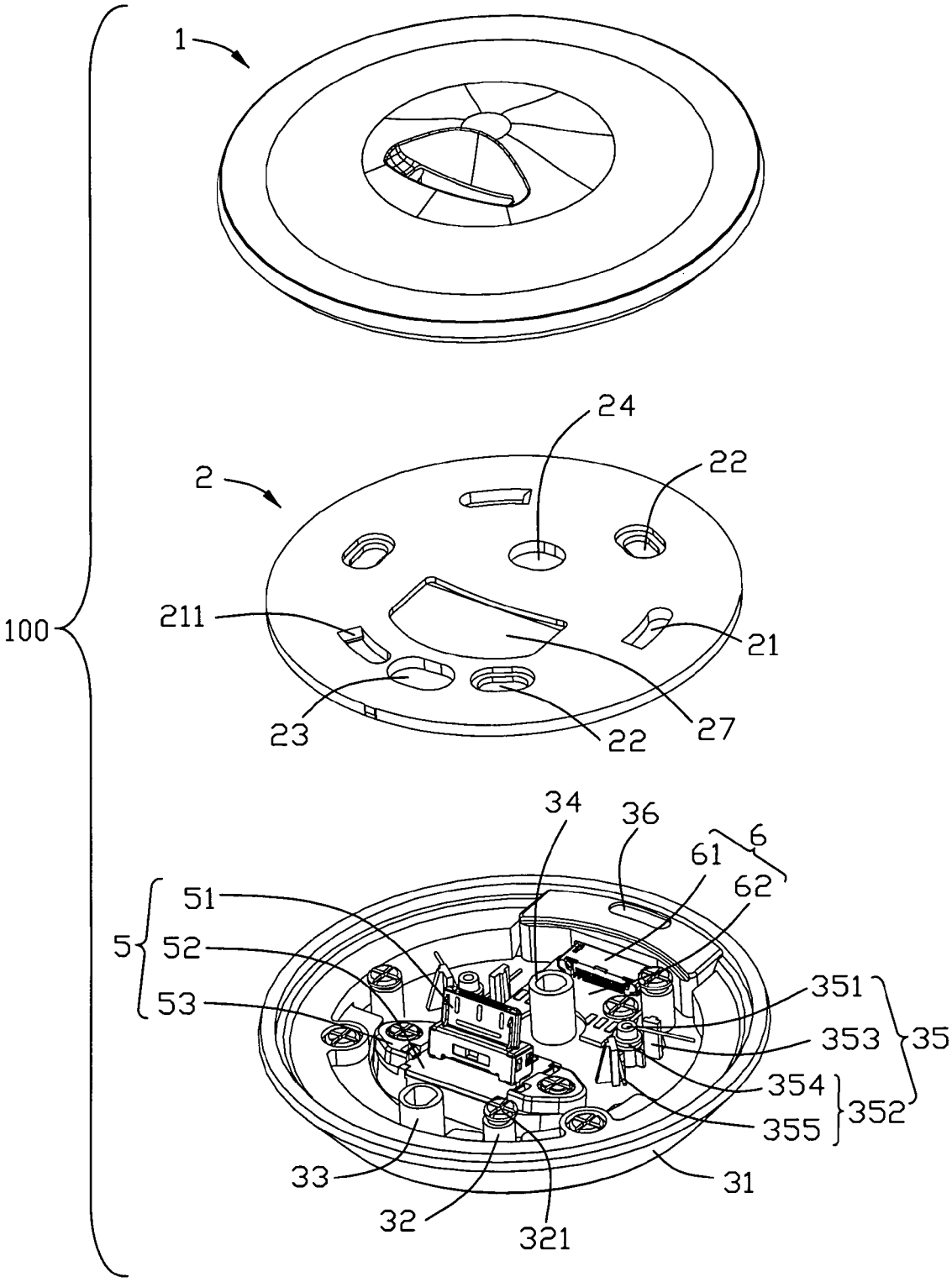
FIG. 2 is a perspective, further exploded view of the electrical connector.
Figure 3:
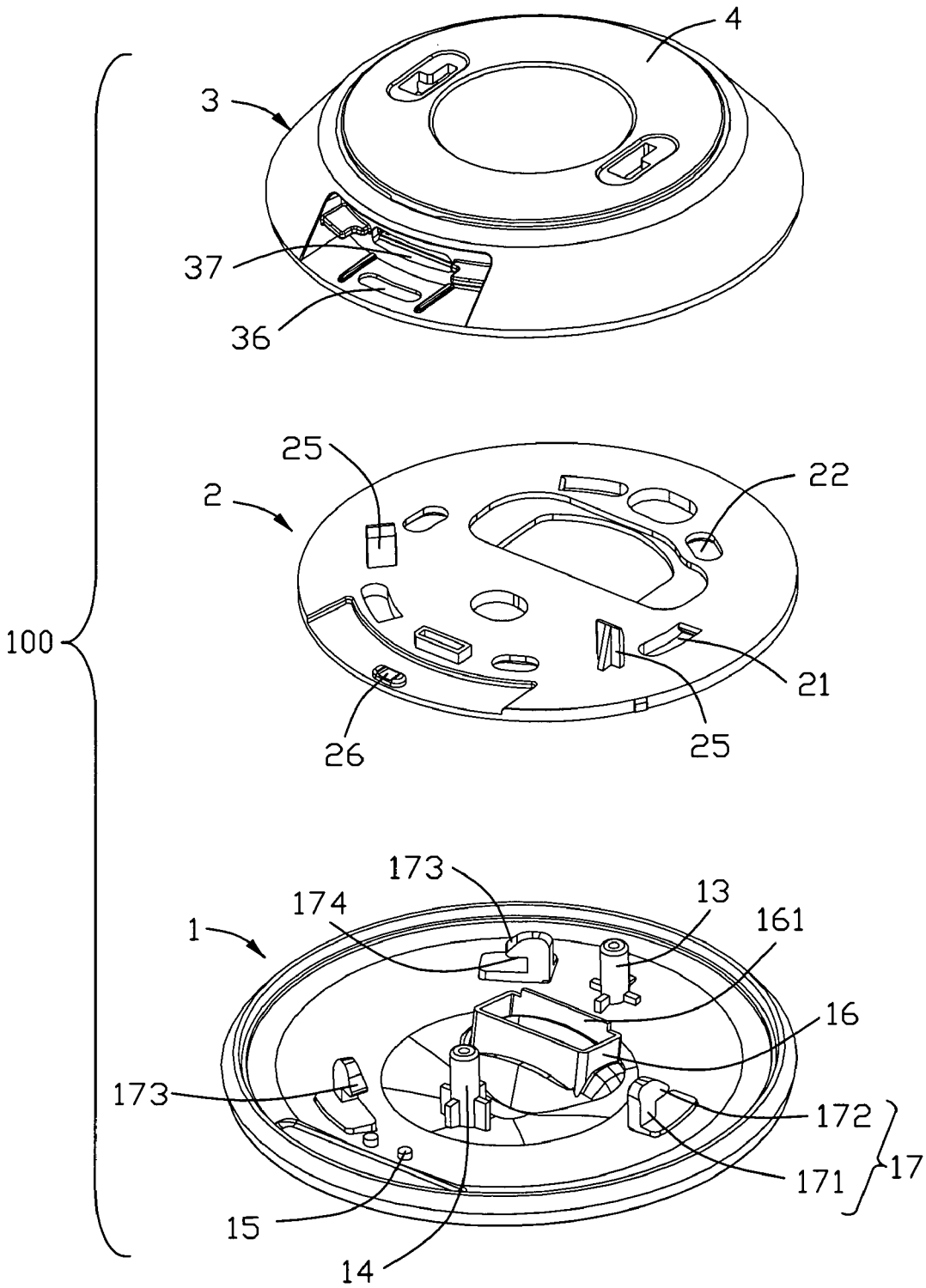
FIG. 3 is a view similar to FIG. 2, but taken from a different aspect.

FIGS. 1-3 illustrate an electrical connector 100 comprising a top cover 1, a base 3 shaped in a basin and an inner cover 2 located between the top cover 1 and the base 3. The inner cover 2 associates with the base 3 for defining a receiving room. A first connector module 5 and a second connector module 6 electrically contacting with the first connector module 5 by cables wires (not shown) are both received in the receiving room. Each connector module 5, 6 communicates with the out space for connecting with a complementary connector (not shown) and transferring information therebetween.

Referring to FIG. 2, the first connector module 5 is slantways assembled on the base 3. The first connector module 5 comprises a supporting body 53, a first circuit board 52 held by the supporting body 53 and a first connecting port 51 soldered on the first circuit board 52. The second connector module 6, flatly lying on the base 3, comprises a second circuit board 62 and a second connecting port 61 soldered on the second circuit board 62. The two circuit boards 52, 62 are electrically connected by cable wires to achieve the electrical connection between the two connector modules 5, 6.

Referring to FIGS. 1-3, the upper cover 1 is circularly shaped, and comprises a cover base 11, an opening 12 defined on an upper surface of the cover base 11 and a pair of orienting posts 13, 14, a retainer 15, a keeping-in frame 16 and a plurality of locking means 17 formed on a lower surface of the cover base 11. The opening 12 is used for receiving the first connecting port 51 and the complementary connector. The pair of orienting posts 13, 14 is unsymmetrical relative to a center of the cover base 11 for preventing mistaken assembly. The keep-in frame 16 communicates with the opening 12 and comprises four vertical walls, one of which extends longer to be a stretching wall 161. The stretching wall 161 confronts the circuit board 52 for keeping the circuit board 52 in the supporting body 53. In the preferred embodiment, the number of the locking means 17 is three and each comprises a pillar 171 extending from the lower surface of the cover base 11 and a fasten portion 172 extending from the distal end of the pillar 171. The fasten portion 172 forms an inclined surface 173 for guiding purpose and a confronting surface 174 connecting the inclined surface 173 with the pillar 171 for locking purpose. Each locking mean 17 looks like a hook.

Referring to FIGS. 2-3, the base 3 comprises a body portion 31, a plurality of limited posts 32, a pair of received posts 33, 34 and a plurality of elastic assemblies 35. The body portion 31 is shaped in a basin and all of the limited posts 32, the received posts 33, 34, and the elastic assemblies 35 extend from the body portion 31 and are received therein. In a preferred embodiment, the number of the limited posts 32 is three so that the limited posts 32 form an isosceles triangle by lining every two limited posts 32. Each limited post 32 is also performed as a hollow one where a screw 321 can be inserted. In a preferred embodiment, the number of the elastic assemblies 35 is two to achieve balanced performance. Each elastic assembly 35 forms a pair of baffles 353, one facing to the other, and an angle is formed along an extended line defined thereby. Each elastic assembly 35 further comprises a spring 352 and a column 351. Each spring 352 forms a helix 354 and a pair of spring arms 355 extending from two free ends of the helix 354. The helix 354 of the spring 352 sheaths over the column 351 and at least one spring arm 355 is leaned against the adjacent baffle 353. The base 3 further comprises a slit 36 and a gap 37 close to the slit 36 on an outer surface of the body portion 31.

Referring to FIGS. 2-3, a circular inner cover 2 is located between the top cover 1 and the base 3. The inner cover 2 defines a plurality of fixing slots 21, a plurality of limiting slots 22 and a pair of receiving slots 23, 24. The fixing slots 21 and the limiting slots 22 are respectively mated with the locking means 17 and the limited posts 32, and the amount of them respectively depends on the number of the locking means 17 and the limited posts 32. The fixing slots 21 and the limiting slots 22 are alternately located. The fixing slot 21 further forms a slope 211 at a left side thereof along a clock direction taken from a top view. The lower surface of the inner cover 2 forms a pair of blocks 25 and a heave 26 which is acted as a switch. An aperture 27 takes up a large space at an almost center part of the inner cover 2 for the first connecting port 51 going across.

The fixing slots 21, the limiting slots 22, the pair of receiving slots 23, 24, the aperture 27, the slit 36 and the gap 37 are all shaped in arcs, each of their centers defined by the arcs is just the center defined by the circle of the inner cover 2, therefore, when the inner cover 2 rotates around along a clockwise or an anticlockwise direction, some other components received in the above arcs 21, 22, 23, 24, 27, 36, 37 also rotate therein.

Figure 9:
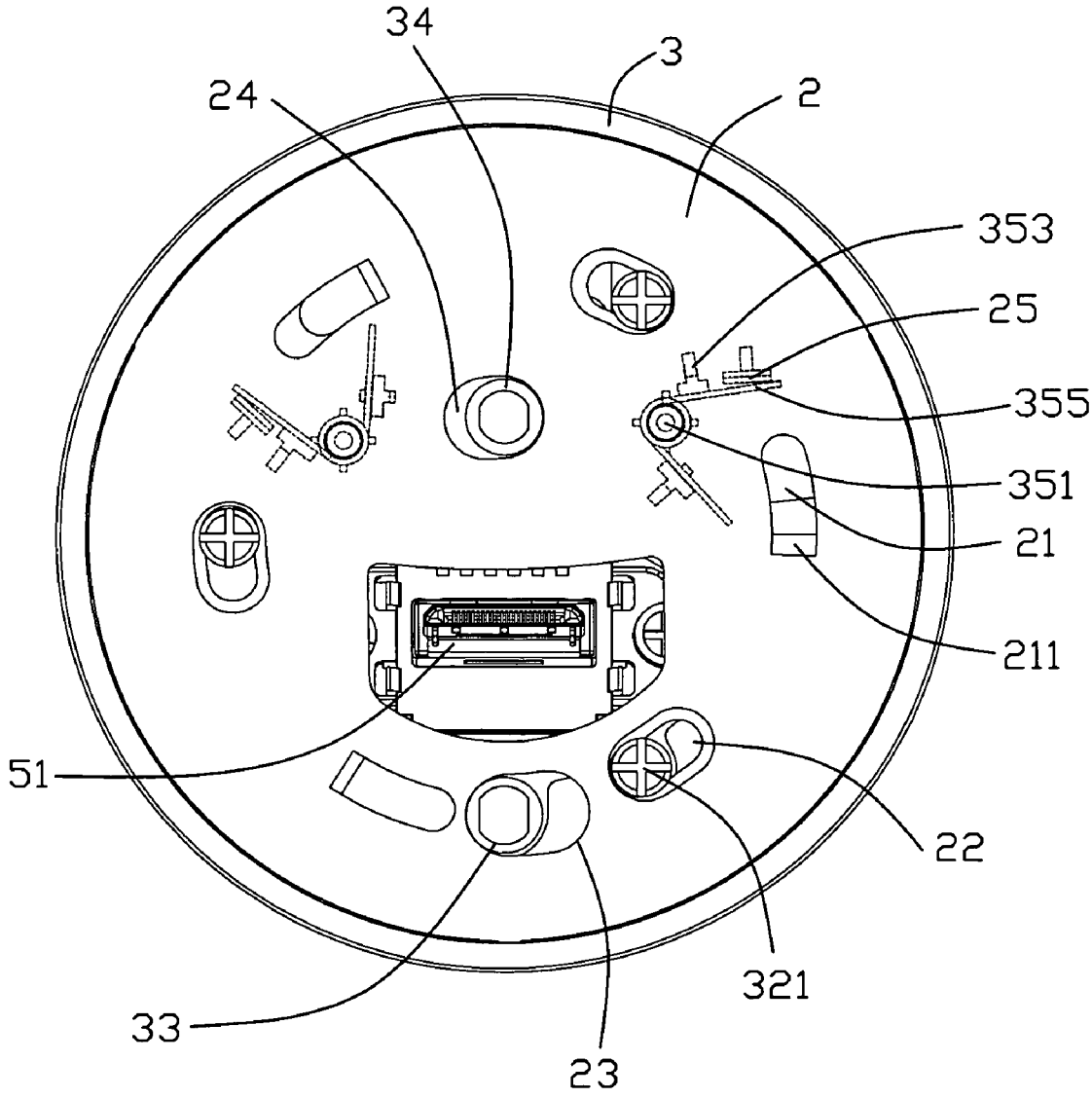
FIG. 9 is a cross-section view of the electrical connector of FIG. 2 located in a locked position.

In assembly, put the inner cover 2 onto the base 3 and make sure that the limited posts 32, the pair of received posts 33, 34 are respectively and correspondingly received in the limiting slots 22 and the pair of receiving slots 23, 24 at a left side thereof, and then, the screw 321 is screwed onto each limited post 32 for combining the inner cover 2 and the base 3 together, and the combination therebetween is not so much tight that the inner cover 2 is movable in an allowable range. The first connecting port 51 goes through the aperture 27 while the second connecting post 61 goes through the gap 37. The heave 26 is located at a locked position in the slit 36. Each block 25 is respectively aligned with one of the spring arm 355 of the corresponding elastic assembly 35; meanwhile, the block 25 and the baffle 353 are kept at a same side of the spring arm 355. A cross-section view of the inner cover 2 and the base 3 in a locked status is shown as FIG. 9.

Figure 10:
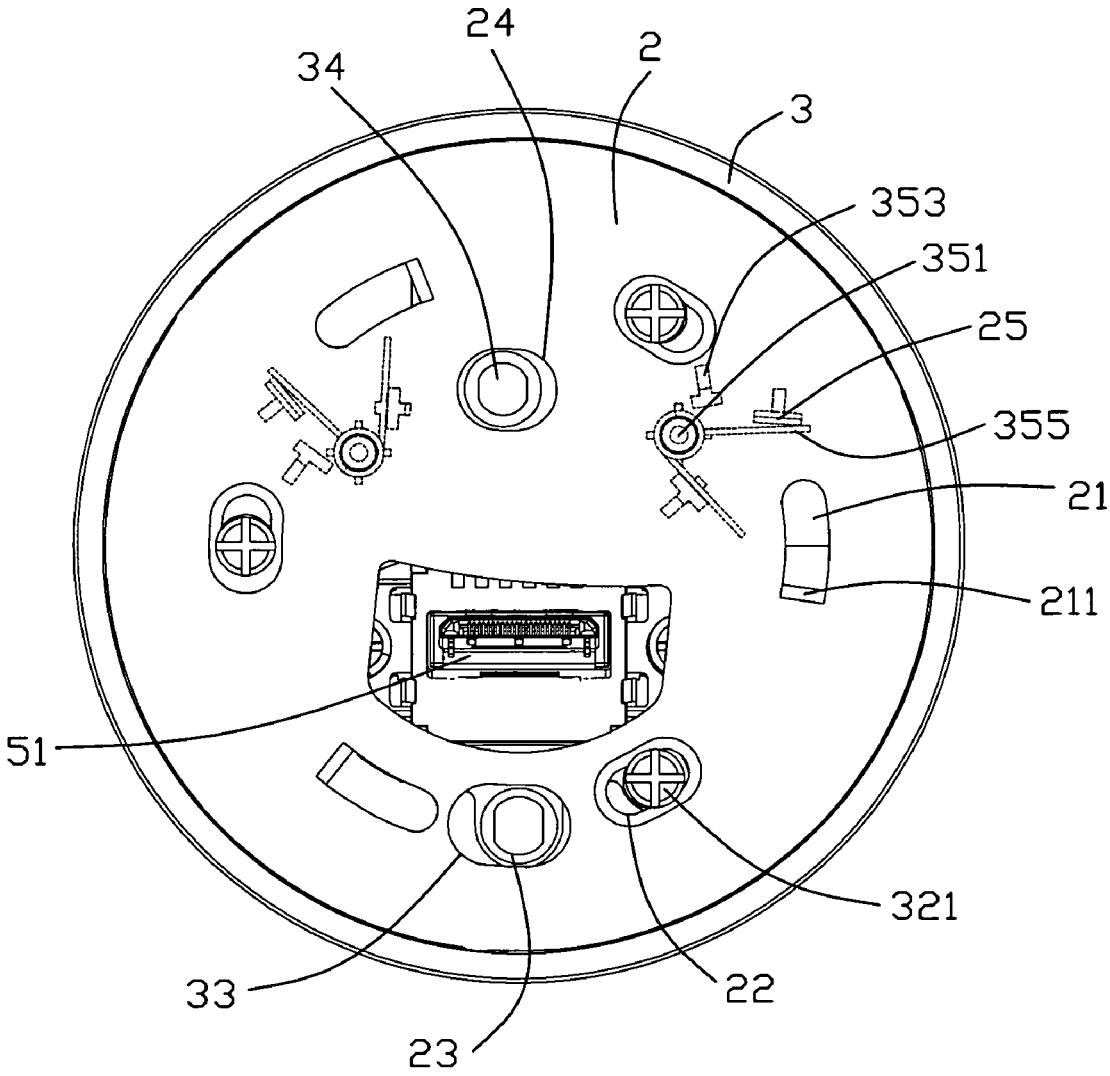
FIG. 10 is a cross-section view of the electrical connector of FIG. 2 located in an unlocked position.

Attach the top cover 1 to the inner cover 2 and the base 3, because of a larger length of the orienting posts 13, 14, the orienting posts 13, 14 are firstly received in the received posts 33, 34 for orientation purpose. The locking means 17 extend into the fixing slots 21 under the guidance of the inclined surfaces 173. A hypo-force of a press force on the top cover 1 acted by users leads the inner cover 2 to rotate along the clockwise direction, and the rotation of the inner cover 2 drives the blocks 25 to give a pressure to the spring arms 355, which causes the spring arms 355 to move away from their original positions. At this moment, the whole electrical connector 100 is at an unlocked status shown as FIG. 10. Until the inclined surfaces 173 don't touch with the slops 211, elastic forces formed by the spring arms 355 drive the blocks 25 and further drive the inner cover 2 to move along the counterclockwise direction, meanwhile, the slops 211 slide under the confronting surfaces 174 so as to cause an attachment between the top cover 1 and the inner cover 2. The electrical connector 100 is positioned at a locked status again and the whole assembling process is over.

In a disassembling process of the electrical connector 100, users only need to move the heave 26 received in the slit 36 from the locked position to the unlocked position with hand, hence, the inner cover 2 moves relative to the top cover 1 and the base 3, and accordingly, the slops 211 disengage away from the locking means 17, which causes disappearance of the attachment between the top cover 1 and the inner cover 2. In practice, a user only need to move the heave 26 from the locked position to the unlocked position and the pollex presses against the top cover 1 to make the retainer 15 acted as a fulcrum and then bring a raising up of the other end of the top cover 1 distant away from the heave 16, accordingly, the user can favorably take away the top cover 1 therefrom.

Figure 4:
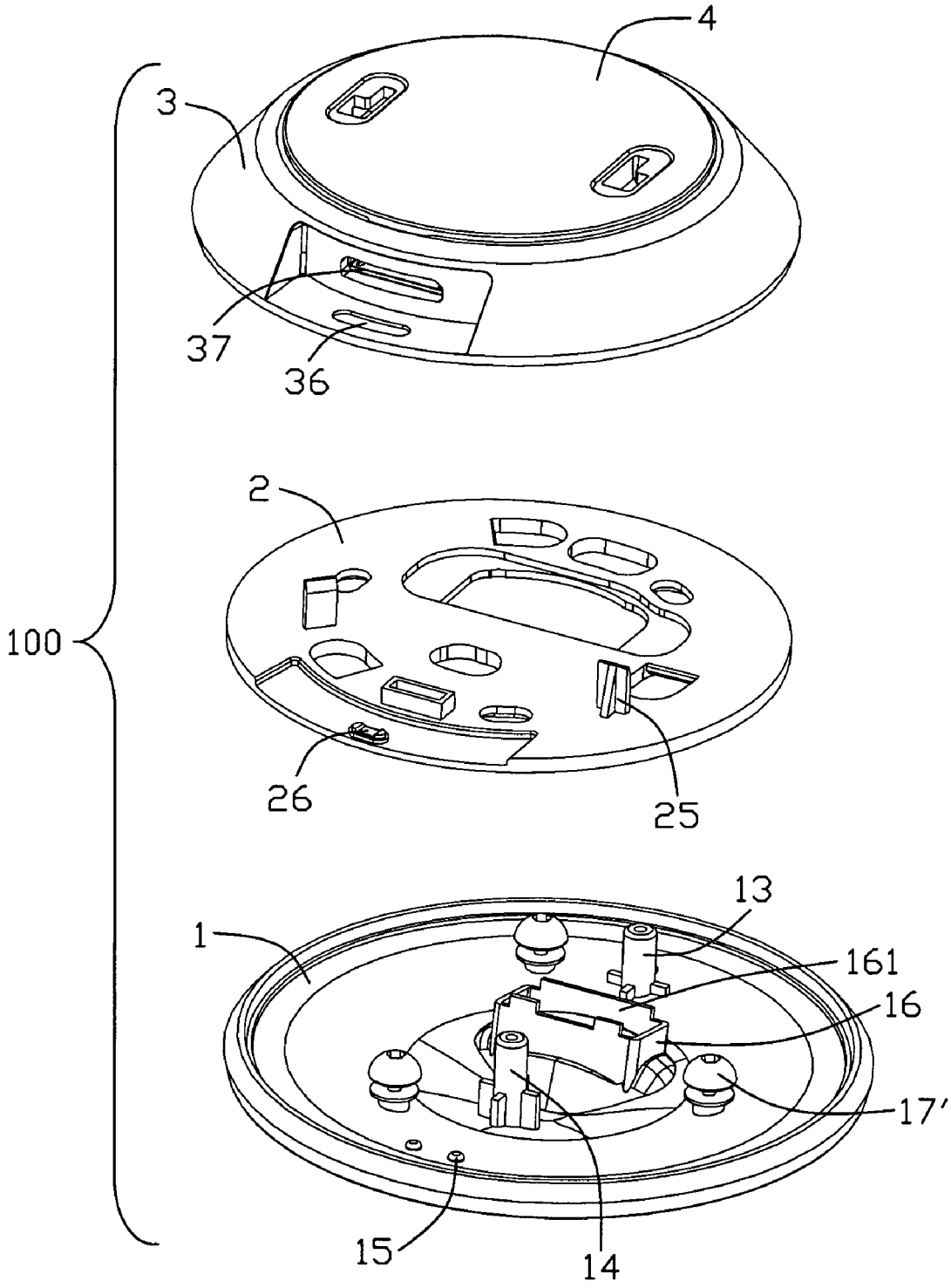
FIG. 4 is a view similar to FIG. 3, but has a different locking means used in the first combined assembly.
Figure 5:
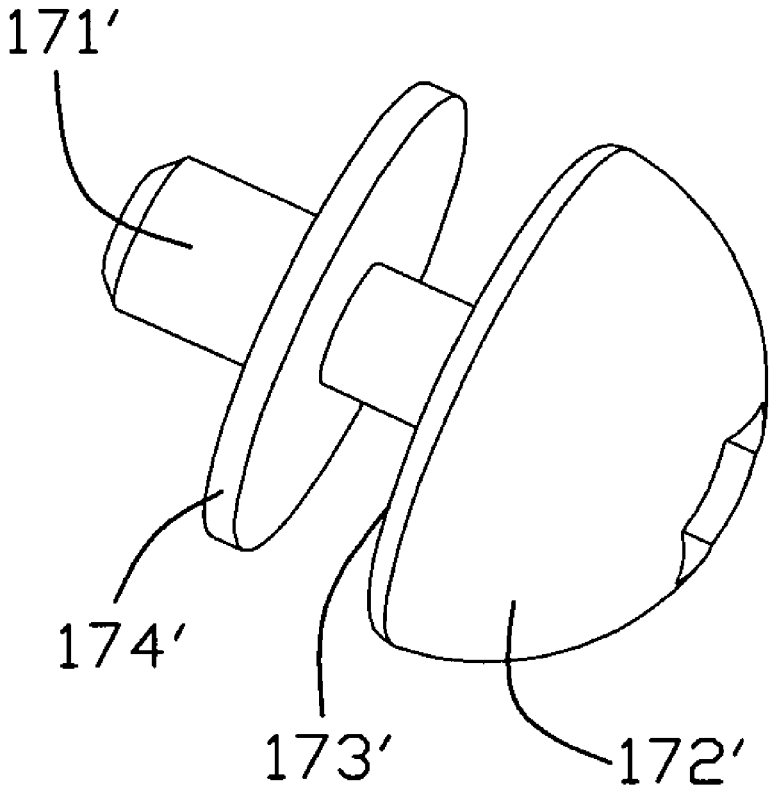
FIG. 5 is a perspective view of the screw used as the different locking means of the first combined assembly.

A second embodiment of the combination method between the top cover 1 and the inner cover 2 is shown as FIG. 4, in which the locking means 17 are replaced by the screws 17' and an amplified perspective view of the screw 17' is shown as FIG. 5. Each screw 17' comprises a pillar portion 171' extending from the lower surface of the cover body 11, a screw cap 172' formed at a distal end of the pillar portion 171' and a flat portion 174' encircling the middle part of the pillar portion 171'. The screw cap 172' forms a bottom surface 173' thereof both parallel to the flat portion 174' and the lower surface of the cover body 11. The assembling process of the second embodiment is similar to that of the first embodiment said above, because the screw cap 172' of the screw 17' is acted as the inclined surface 173 of the locking mean 17 for guiding purpose and the bottom surface 173' of the screw cap 172' is acted as the confronting surface 174 of the locking mean 17 for locking purpose. An interspace defined by the bottom surface 173' and the flat portion 174' is used for receiving the slop 211.

Figure 6:
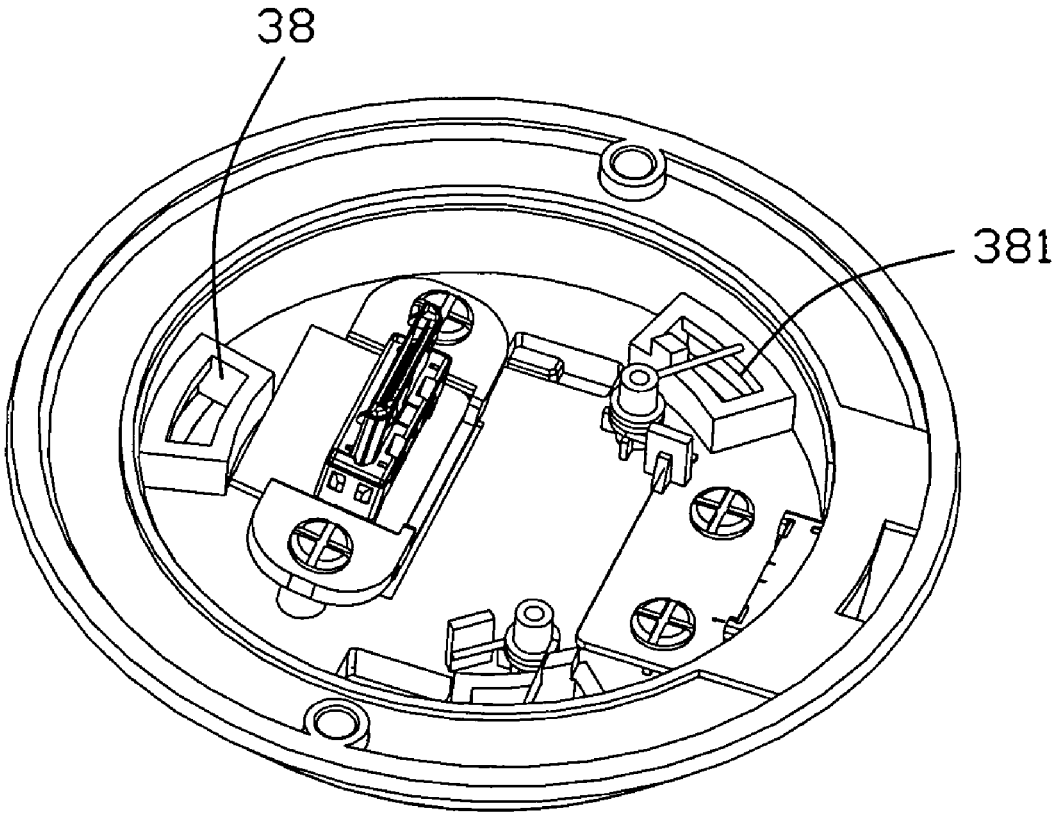
FIG. 6 is a perspective view of a different kind of a bottom shield used in a second combined assembly of the electrical connector.
Figure 7:
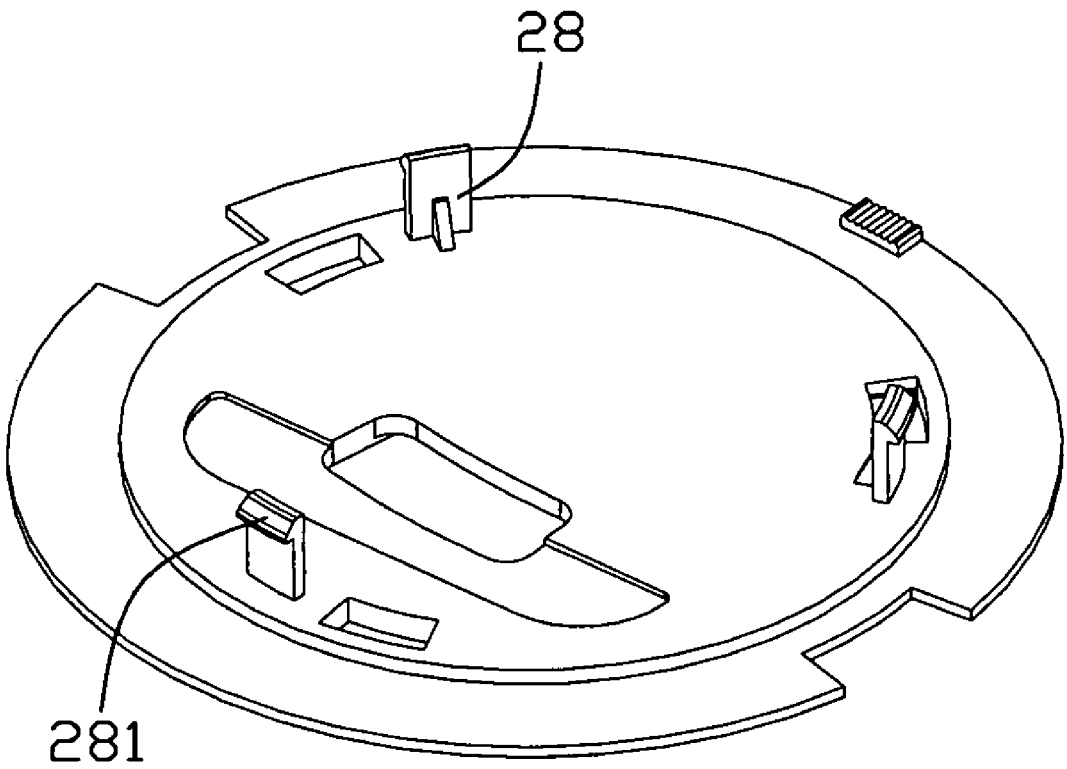
FIG. 7 is a perspective view of an inner cover mating with the bottom shield of the FIG. 6 to form the second combined assembly.

A second embodiment of the combination method between the base 3 and the inner cover 2 is shown as FIGS. 6-7. A pair of sticks 28 extends from the lower surface of the inner cover 2 and each has a claw portion 281 at a free end thereof, which has a little elasticity. A pair of perforations 38, each having a stepped portion 381, is formed on the base 3. In assembly, the sticks 28 penetrate into the perforations 38 because the claw portions 281 are compressed, and ultimately, the stepped portions 381 engage with the claw portions 281 for combining the inner cover 2 and the base 3 together.

Figure 8:
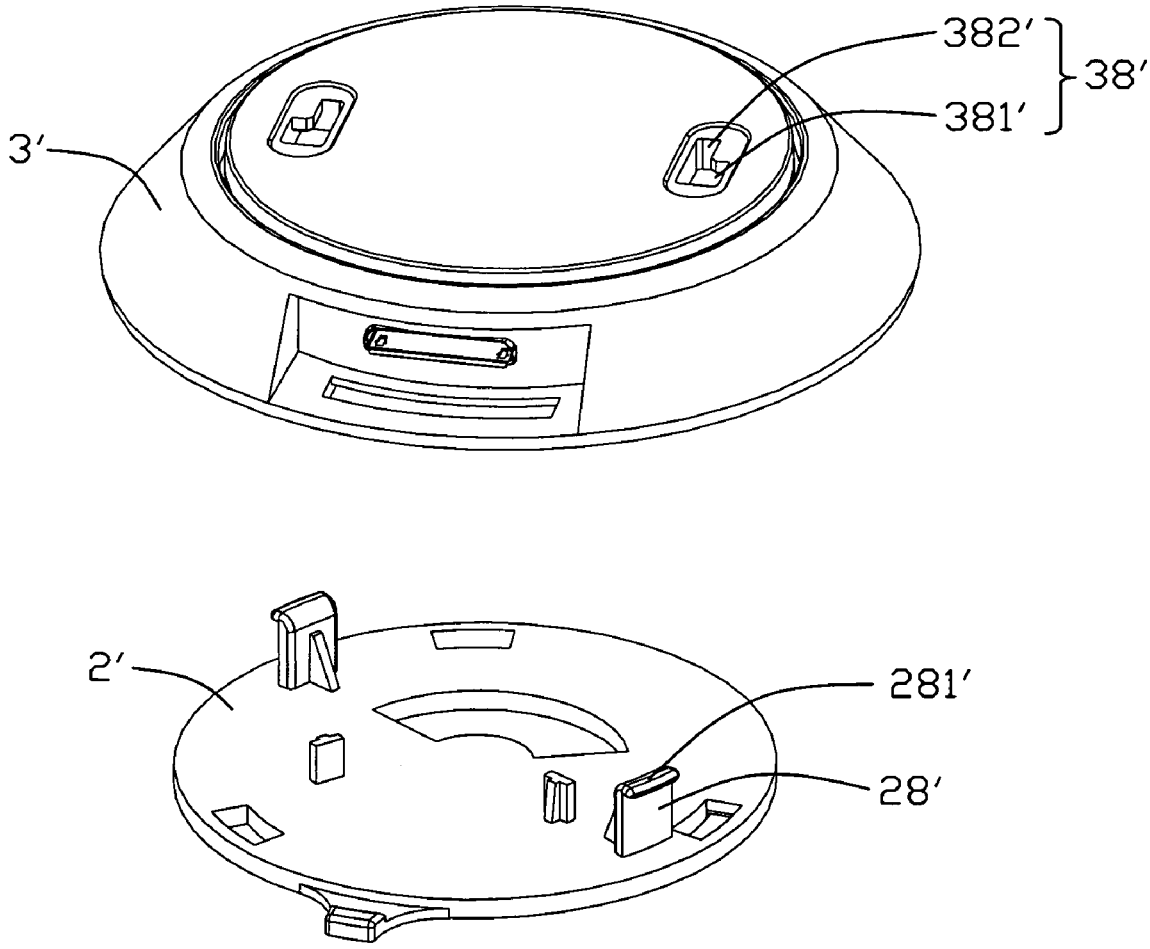
FIG. 8 is a third embodiment of the second combined assembly.

A third embodiment of the combination method between the base 3 and the inner cover 2 is shown as FIG. 8, which is similar to FIGS. 6-7. A pair of sticks 28' extends from the lower surface of the inner cover 2 and each has a claw portion 281' at a free end thereof. A pair of perforations 38' is formed on the base 3. Each perforation 38' comprises a wider perforation 381' and a narrower perforation 382' communicating with the wider perforation 381'. In assembly, the sticks 38' penetrate into the wider perforations 381' first, and then, slide into the narrower perforations 382'. Ultimately, the claw portions 281' mate with a lower surface of the base 3.

The electrical connector 100 disclosed in the present invention, comprises the inner cover 2 arranged between the top cover 1 and the base 3. The top cover 1 is attached to the base 3 by virtue of the inner cover 2 rotating around under the elastic forces of the elastic assemblies 35, which makes the assembly process and disassembly process simple and protects the electrical connector 100 from being destroyed. The connector modules 5, 6, the cable wires, the elastic assemblies 35 and other members are all received in a receiving room defined by the top cover 1 and the base 3, which improves an aesthetic impression of the product.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical connector, comprising:

a base, shaped in a basin, comprising at least one elastic assembly;

a first connector module and a second connector module both assembled on the base and electrically connected to each other, each connector module communicating with an outside complementary connector;

an inner cover attached to the base and defining a plurality of fixing slots thereon; and a top cover comprising a plurality of fixing members corresponding to the fixing slots of the inner cover; wherein the fixing members are engaged with or separated from the fixing slots by a rotation of the inner cover along a clockwise or counterclockwise direction by virtue of the elastic assembly wherein the inner cover includes a leave exposed to an exterior so as to allow a user to rotate the inner cover for disassembling the top cover from the inner cover.

2. The electrical connector as described in claim 1, wherein each elastic assembly comprises a pair of baffles, a column and a spring oriented by the baffles and the column.

3. The electrical connector as described in claim 2, wherein the spring comprises a helix sheathing over the column and a pair of spring arms extending from two free ends of the helix and the spring arms are leaned against the baffle.

4. The electrical connector as described in claim 3, wherein the inner cover comprises a pair of blocks each aligned with the spring arm and the block and the baffle are kept at a same side of the spring arm.

5. The electrical connector as described in claim 1, wherein the fixing member of the top cover comprises a pillar and a fasten portion extending from a distal end of the pillar.

6. The electrical connector as described in claim 5, wherein the fasten portion is shaped as a hook.

7. The electrical connector as described in claim 5, wherein the fasten portion is shaped as a screw member.

8. The electrical connector as described in claim 7, wherein the screw member further forms a flat portion encircling the middle part of the pillar.

9. The electrical connector as described in claim 1, wherein the base forms a plurality of limited posts passing through limiting slots which are defined on the inner cover and screwing with a plurality of screws.

10. The electrical connector as described in claim 9, wherein the fixing slots and the limiting slots alternately defined on the inner cover.

11. The electrical connector as described in claim 1, wherein the inner cover comprises a plurality of sticks received in a plurality of perforations defined on the base.

12. The electrical connector as described in claim 11, wherein each stick forms a claw portion and each perforation forms a stepped portion engaging with the claw portion.

13. The electrical connector as described in claim 11, wherein each perforation comprises a wider perforation and a narrower perforation communicating with the wider perforation.

14. The electrical connector as described in claim 1, wherein the top cover comprises a pair of orienting posts, the inner cover defines a pair of receiving slots, the base comprises a pair of received posts, and the orienting posts are inserted into the received posts via the receiving slots.

15. The electrical connector as described in claim 1, wherein the top cover comprises a retainer close to an edge thereof and the inner cover comprises a heave received in a slit defined on the base.

16. The electrical connector as described in claim 1, wherein each connector module comprises a connecting port and a circuit board soldered with the connecting port.

17. The electrical connector as described in claim 16, wherein the first connector module further comprises a supporting body for holding the circuit board.

18. An electrical connector comprising:

a base equipped with at least one elastic assembly;

a first connector module and a second connector module both assembled on the base and electrically connected to each other, each connector module communicating with an outside complementary connector;

an inner cover including a plurality of first fixing devices and attached to the base under a condition that the inner cover is allowed to be rotated with regard to the base at locked and unlocked positions, while being urged by the elastic assembly to be in the locked position; and a top cover comprising a plurality of second fixing devices corresponding to the first fixing devices of the inner cover; wherein the second fixing devices are engaged with or separated from the first fixing devices by rotation of the inner cover to the locked position or the unlocked position assembly wherein the inner cover includes a leave exposed to an exterior so as to allow a user to rotate the inner cover for disassembling the top cover from the inner cover.

19. The electrical connector as claimed in claim 18, wherein the first fixing devices are slots and the second fixing devices are hooks.

* * * * *